US012642329B2

(12) United States Patent
Brueggemann et al.

(10) Patent No.: US 12,642,329 B2
(45) Date of Patent: Jun. 2, 2026

(54) SHOE SOLE FOR A RUNNING SPORTS SHOE OR SHOE

(71) Applicants: BA GmbH, Cologne (DE); shoe dog GmbH, Muenster (DE)

(72) Inventors: Gert-Peter Brueggemann, Cologne (DE); Andre Kriwet, Münster (DE)

(73) Assignees: BA GmbH, Cologne (DE); shoe dog GmbH, Muenster (DE)

( * ) Notice: Subject to any disclaimer, the term of this patent is extended or adjusted under 35 U.S.C. 154(b) by 201 days.

(21) Appl. No.: 17/303,888

(22) Filed: Jun. 9, 2021

(65) Prior Publication Data

US 2021/0330027 A1 Oct. 28, 2021

Related U.S. Application Data

(63) Continuation of application No. PCT/EP2019/084117, filed on Dec. 9, 2019.

(30) Foreign Application Priority Data

Dec. 10, 2018 (EP) ..... 18211252

(51) Int. Cl.
*A43B 13/18* (2006.01)
*A43B 13/04* (2006.01)
(Continued)

(52) U.S. Cl.
CPC ..... *A43B 13/186* (2013.01); *A43B 13/04* (2013.01); *A43B 13/125* (2013.01); *A43B 13/188* (2013.01); *A43B 13/32* (2013.01)

(58) Field of Classification Search
CPC ..... A43B 13/186; A43B 13/04; A43B 13/125; A43B 13/188; A43B 13/32; A43B 13/14; A43B 7/14; A43B 5/06; A43B 13/16
See application file for complete search history.

(56) References Cited

U.S. PATENT DOCUMENTS 3,494,055 A * 2/1970 McSorley ..... A43B 13/26 D2/962
5,168,643 A * 12/1992 Laurain ..... A43B 13/00 36/25 R (Continued)

FOREIGN PATENT DOCUMENTS

CA 2 841 562 A1 1/2013
DE 32 45 182 A1 5/1983

(Continued)

*Primary Examiner* — Haley A Smith
(74) *Attorney, Agent, or Firm* — Orbit IP, LLP; Marc G. Martino

(57) ABSTRACT

A running shoe sole has an elastically deformable supporting sole, which has a rear and front foot section connected to each other via a coupling section. An elastically deformable supporting device is arranged on the supporting sole and carries an outsole covering. The supporting device includes a rear foot part which engages around the rear foot section of the supporting sole in a U shape and a front foot part having two limbs which are arranged on mutually opposite lateral edge sections of the front foot section. The rear and front foot part each have a supporting surface, which runs obliquely inward toward the underside of the shoe sole or is curved, preferably convex, and on which the supporting sole rests and is supported in the lateral direction. The rear and front foot parts are made from a highly responsive thermoplastic elastomer of 45-50 Asker Shore C density.

12 Claims, 5 Drawing Sheets

(51) Int. Cl.
*A43B 13/12* (2006.01)
*A43B 13/32* (2006.01)

(56) References Cited

U.S. PATENT DOCUMENTS 5,533,280 A * 7/1996 Halliday ..... A43B 3/24 36/15
5,595,004 A 1/1997 Lyden et al.
5,987,780 A * 11/1999 Lyden ..... A43B 13/203 36/35 B
9,282,784 B2 * 3/2016 Adeagbo ..... A43B 13/184
2003/0208929 A1 * 11/2003 Lucas ..... A43B 3/0063 36/27
2007/0240331 A1 * 10/2007 Borel ..... A43B 13/026 36/28
2009/0151093 A1 6/2009 Schindler et al.
2010/0325914 A1 12/2010 Peyton
2011/0225852 A1 9/2011 Mahoney
2013/0019497 A1 1/2013 Sullivan et al.
2013/0047474 A1 2/2013 Healy et al.
2013/0126075 A1 5/2013 Jiang
2014/0059883 A1 * 3/2014 Adeagbo ..... A43B 13/184 36/28
2014/0259784 A1 * 9/2014 Jenkins ..... A43B 13/223 36/102
2015/0082669 A1 * 3/2015 Peikert ..... A43B 7/08 36/30 R
2016/0073732 A1 3/2016 Ernst et al.
2016/0219975 A1 * 8/2016 Wright ..... A43B 13/04
2016/0295963 A1 * 10/2016 Chang ..... A43B 1/0072
2016/0338446 A1 * 11/2016 Merlo ..... A43B 13/20
2018/0271210 A1 * 9/2018 Tanaka ..... A43B 17/14
2018/0368516 A1 * 12/2018 Mason ..... A43B 7/1475
2021/0015206 A1 * 1/2021 Boys ..... A43B 13/122

FOREIGN PATENT DOCUMENTS

EP 0 893 074 A2 1/1999
EP 1 844 673 A1 10/2007
EP 3 132 704 A1 2/2017
WO 2013/012626 A1 1/2013
WO 2018/070045 A1 4/2018

* cited by examiner

SHOE SOLE FOR A RUNNING SPORTS SHOE OR SHOE

CROSS-REFERENCE TO RELATED APPLICATIONS

This continuation application claims priority to PCT/EP2019/084117 filed on Dec. 9, 2019 which has published as WO 2020/120351 A1 and also the European patent application No. 18211252.4 filed on Dec. 10, 2018, the entire contents of which are fully incorporated herein with these references.

DESCRIPTION

Field of the Invention

The invention relates to a shoe sole for a sports shoe and a shoe, in particular a sports shoe for the sport of running.

Background of the Invention

In conventional sports shoes, in particular those for the sport of running, the cushioning and stabilization, i.e. the support and guidance of the foot during the standing and push-off phase through the shoe sole, is of decisive importance. The shoe soles usually have an intermediate or supporting sole with support and cushioning elements attached to it, which are intended to compensate for misalignments of the feet, in particular a frequently present overpronation or a seldom encountered supination of the foot. This type of running shoe is therefore often differentiated by the manufacturer into so-called stable or neutral shoes. In this established shoe sole or sole concept, essential biomechanical aspects of running, in particular musculoskeletal effects of the ground reaction forces that occur when running, have not yet been sufficiently taken into account. When walking, the ground reaction force describes the reaction force of the ground to the force that the body transmits to the ground through the shod or unshod feet when stepping on it. The so-called force application point (FAP) identifies the origin of the vector of the ground reaction force acting from the force components acting in the running direction (x-direction according to a right-handed three-dimensional coordinate system with x-, y-, and z-axes), in the vertical direction (z-direction) and in the lateral or medial direction (y-direction).

The force application point is localized when the foot impacts the ground in the rear part of the foot or the shoe. During further contact with the ground, the FAP moves from back to front, so that it is located approximately in the middle of the front foot when pushing off the ground. Runners who initially make contact with the ground with the heel, i.e. over 80% of all runners, initially touch with the foot laterally at the rear (=outside) and thus have the FAP in a pronounced manner at the rear on the lateral edge of the foot or shoe sole. Even runners who touch the ground flat with the feet show the FAP laterally at the back, only correspondingly in a less pronounced manner. In comparison, the proportion of so-called front foot runners is negligible, at less than 1%.

In the sagittal plane, the ground reaction force (i.e. its anterior-posterior force component (x-direction) and its vertical force component (z-direction) acts on the ankle first (after the foot is placed) behind the joint's axis of rotation. The FAP is therefore located behind (posterior to) the axis of rotation of the ankle. The direction of force upward to the back creates an external torque, which initiates a plantar flexion of the foot in the ankle.

As soon as the FAP under the ankle moves in the direction of the foot axis (in the x-direction) anteriorly, i.e. to the front, the external torque at the ankle changes its sign and direction. This accelerates the dorsiflexion of the ankle. This externally generated moment of dorsiflexion is balanced by the plantar flexion muscles, in particular the triceps surae muscle, the dorsiflexion is slowed down, and ultimately the ankle experiences the plantar flexion for pushing off of the ground.

With regard to the knee, the ground reaction force acts in the sagittal plane behind the knee and generates an external flexion moment. The knee extension muscles, i.e. the Mm. vasti, and the M. rectus femoris, oppose an internal extension moment. As a result, the flexion of the knee is slowed down in the early supporting phase and the knee joint is stretched to push off.

In the frontal plane, the ground reaction force, that is, its medio-lateral (in the ml- or y-direction) force component and its force component pointing in z-direction) at the ankle joint in the early supporting phase generates an external eversion moment, which tilts the rear foot inward and pushes the ankle medially with the distal tibia.

Due to the play of forces of the ml force component and the ap force component of the ground reaction force in the transverse plane (=horizontal plane), the heel bone (calcaneus) is rotated inward around the vertical axis and adducted. With the eversion and adduction of the rear foot, an internal rotation is imparted to the talus and, consequently, the tibia. This accelerated internal rotation of the tibia results in an increasing torque in the transverse plane in the knee joint (=ERM). Medialization of the distal tibia results in increased adduction of the knee joint. With the medialization of the ankle, the FAP shifts medially in the further course. The result is an increase in the leverage of the ground reaction forces in the frontal plane with respect to the knee joint. This increases the external adduction moment at the knee (=EAM).

In the push-off phase or in the second part of the standing phase when running, the FAP is initially located laterally and only finally medially under the front foot. During the early push-off (with the greatest external and internal forces) the FAP is lateral to the ankle (and knee) and creates an increasing eversion against the force of the inversion muscles (M. tibialis anterior, M. tibialis posterior, M. flexor hallucis) of the rear foot and, with the resulting medialization of the distal tibia, an adduction of the knee. The external adduction torque (EAM) and the torque (ERM) in the transverse plane (ERM) at the knee are therefore increased further.

Through the use of shoes, especially those with angular shoe soles, the ml shift (y-direction) and, as a result, the leverages of the ground reaction forces in the frontal plane at the ankle and knee are unnecessarily increased. On the other hand, in the unshod foot—due to the fat pad ring around the heel bone—an early ml-centering of the FAP is achieved in the early standing phase under the heel bone and thus under the ankle and knee. As a result, the external moments in the frontal plane and in the transverse plane are significantly reduced compared to running in shoes. In the push-off phase with the FAP under the front foot, with an unshod foot, the partial movements of the five rays of the foot and the anatomical transverse arching that is present when the front foot is not loaded (when the metatarsal heads come into contact with the ground) result in a physiological ml-centering of the FAP and consequently a reduction in the leverage of the ground reaction forces in the frontal plane at the ankle and knee.

As is well known, running injuries are often chronic injuries that most often affect the knee. Primarily responsible are the higher external adduction moments (EAM) in the frontal plane and transverse rotation moments (ERM) in the sport of running compared to less demanding forms of movement. If the external torques in the frontal plane and the transverse plane through the shoe soles of conventional running shoes compared to running without shoes on a soft surface, e.g. grass, are increased, higher loads on the passive structures of the joints as well as on those muscles that counteract these external moments inevitably occur. As a result, walking on conventional shoe soles is often more stressful on the joints and simultaneously less efficient, since more muscle work is necessary and this increased muscle work is simultaneously not effective.

SUMMARY OF THE INVENTION

Object of the Invention

It is therefore the object of the invention to provide a shoe sole for a running shoe as well as a shoe, in particular a sports shoe for the sport of running, which offer a more physiological sequence of movements with improved comfort when running and in particular counteract causes of improper strain on the ankle and knee and which are not exhausted by a symptom elimination of overpronation and knee adduction. Unnecessary loads on the musculoskeletal system should therefore be minimized and muscle work that is not effective for propulsion should be reduced to a minimum.

Technical Solution

The object relating to the shoe sole is achieved by a shoe sole having the features specified in claim 1. The shoe according to the invention has the features specified in claim 12.

The shoe sole according to the invention comprises an elastically deformable supporting sole which has a rear foot section and a front foot section, which are connected to one another via a coupling section (metatarsal bridge). An elastically deformable supporting device is arranged on the supporting sole and is provided with an outsole covering on the underside, wherein the supporting device comprises the following: a rear foot part which engages around the rear foot section of the supporting sole in a U shape; and a front foot part with two limbs which are arranged on opposite lateral edge sections of the front foot section, wherein the rear foot part and the front foot part each have at least one supporting surface which is inclined inward toward the underside of the shoe sole r curved, preferably convex, and on which the supporting sole rests and is supported in the lateral direction.

The supporting sole is essentially comparable to the classic insole of a shoe sole and, according to the invention, can for example consist of a viscoelastic foam (for example an ethylene-vinyl acetate polymer (EVA) or copolymer (EVAC), in particular having a density of approximately 55 Asker ShoreC), a fiber composite material (e.g. carbon) or the like. The supporting sole can be flexibly deformed in any case.

The supporting sole of the shoe sole is therefore supported in the region of its edge section on the rear foot part and on the front foot part in the direction of the vertical axis of the supporting sole and in a direction radial to the vertical axis toward the outside. The supporting sole is therefore arranged in portions between the supporting device in the loaded and also in the unloaded operating state, that is to say at any point in time. When the shoe sole is used as intended, a force application point of the ground reaction force located eccentrically with respect to the longitudinal center axis of the supporting sole can be centered in the direction of the longitudinal center axis of the supporting sole at any point in the standing phase. Due to the circular arc-shaped arrangement of the rear foot part of the elastically deformable supporting device in the rear region of the supporting sole, when the foot is placed on the supporting sole of the shoe sole, the point of application of the ground reaction force can be directed directly into the center of the U shaped rear foot part of the supporting device and thus under the heel bone of the foot, regardless of the contact point or the contact direction, and thus centered under the heel bone and the still neutral ankle. In the case of a force application point of the ground reaction force acting laterally offset with respect to the longitudinal center axis, the associated eccentric compression of the rear foot part due to the inventive mounting of the support plate on the elastically deformable rear foot part of the supporting device leads to a corrective force directed in the ml direction towards the longitudinal center axis on that support plate section on which the FAP acts.

With regard to the ml deflection described at the beginning, the force application point is found in operational use of the shoe sole below the knee. The posterior part, i.e. the U shaped rear foot part, of the supporting device enables the ap control of the force application point. When walking on the shoe sole, external initial plantar flexion moments at the ankle can be counteracted. The ml-centering of the force application point minimizes or eliminates the cause of the external eversion and adduction moments at the ankle.

Furthermore, it should be noted that the front (anterior) opening of the rear foot part formed by the U shaped rear foot part of the force application point can be controlled like a funnel when the shoe sole comes into contact with the ground and guided in the center and directed to the front foot part of the midsole.

The front foot part of the elastically deformable supporting device makes it possible to assume the force application point from the rear foot section of the shoe sole and to guide it further anteriorly, centrally under the foot.

To facilitate the final completion of the push-off process, the front foot part is preferably open anteriorly. According to an alternative embodiment of the invention, the front foot part can be U shaped in a manner corresponding to the rear foot part and engages around the front foot section of the supporting sole (together with its front free end section or tip). The U shaped front foot part of the supporting device is then advantageously made with a weakened material in the region of the apex, i.e. in the region of the front free end section of the shoe sole or the supporting sole. In this case, the U-shaped front foot part in said region can in particular have an overall height that is reduced compared to the rest of the front foot part (measured in the direction of the vertical axis of the shoe sole).

Contrary to the shoe sole or running shoe concepts mentioned at the outset, the shoe sole according to the invention does not only symptomatically counteract overpronation or eversion or knee adduction. Rather, the causes of these symptoms while running and thus the increased stress on the musculoskeletal system when running compared to (everyday) stresses can be reliably counteracted.

The following advantages can be realized in summary through the shoe sole according to the invention:

- the FAP (force application point) can be centered in the ml direction with respect to the longitudinal center axis or longitudinal center plane in the foot impact and centered anteriorly in the ap (anterior-posterior) direction toward the front foot area. If the shoe sole is used as intended, a minimization of the external torques in the frontal and transverse planes at the ankle and knee (and the reduction of the initial plantar flexion moment at the ankle in the sagittal plane) can be guaranteed;
- ml-centering and ap-conduction of the FAP during front foot support and push-off with the aim of minimizing external torques in the frontal planes at the ankle and knee and improving propulsion efficiency by minimizing muscle work in the secondary planes (frontal and transverse planes); unnecessary loads on the musculoskeletal system are minimized and muscle work that is not effective in propulsion can be reduced to a minimum;
- the FAP can be moved from the rear foot contact to the front foot contact using the biomechanical potential of the biological coupling elements of the metatarsus (ligaments, tendons, intrinsic foot muscles) in the ap direction;
- the FAP centering can be guaranteed for all forms of the foot placement (straight, turned outwards, substantially turned outwards). This is significant in view of the fact that over 90% of all runners do not position their feet in the running direction when the foot is placed, but instead place their feet rotated to the outside by at least 7° and more. In contrast, the shoes available today for running are designed with their flex areas, cushioning and supporting elements for straight foot placement and thus for an exact shoe position in the running direction;
- the potential of the joints and the biological structures of the front foot (including the transverse arching of the unloaded front foot) can be optimally used;
- the movement sequence is more physiological and ensures improved running comfort.

It goes without saying that the shoe sole according to the invention is also suitable for other shoes, in particular sports shoes.

If the supporting surface of the supporting device, in particular the rear foot part of the supporting device, is convexly curved in cross-section, the supporting sole can have a receptacle or pocket for the supporting device, into which the supporting device engages. In this case, the supporting sole preferably has a contact or supporting surface for the supporting device which is curved in a manner corresponding to the supporting surface (that is, shaped complementary to the support surface, therefore concave) in the region of the pocket.

According to the invention, a push-off island with an outsole covering is arranged between the two limbs of the front foot part of the supporting device. The push-off island can for example consist of foamed soft rubber, preferably having a low density of about 40 Asker Shore C.

The surface of the outsole covering of the push-off island is set back, i.e. lowered, relative to the surface of the outsole covering of the two limbs of the front foot part of the supporting device, preferably in the direction of the vertical axis (z-direction) of the shoe sole. In practice it has proven to be particularly advantageous if the height difference mentioned is between 2 and 4 millimeters, in particular 3 millimeters. When the shoe sole is used as intended, the metatarsal heads (anterior ends of the metatarsals) of the foot placed on the shoe sole are slightly curved when the front foot is placed on the ground. The front foot contact thus begins with the contact of the edges of the foot on the medial and lateral limbs of the front foot part of the elastically deformable supporting device. These are immediately deformed when running and lower when force is applied. When the front foot part of the supporting device takes over the load, the transverse curvature of the front foot is released and the now flat row of metatarsal heads penetrates the elastically deformable push-off island with homogeneous load distribution, but central ml position of the force application point. After appropriate compression of the material, in particular foamed elastomer or rubber, the push-off island forms a stable platform for pushing off when running.

According to the invention, the push-off island is preferably segmented by flex zones in order to ensure the necessary flexibility of the shoe sole when it is used. According to the invention, the flex zones can be adapted in their course to an externally rotated foot placement that is often found in runners.

According to a preferred embodiment of the invention, the limb of the rear foot part arranged medially on the supporting sole and the medially arranged limb of the front foot part can merge into one another in the region of the coupling section (metatarsal bridge of the supporting sole). In other words, the two aforementioned limbs can be made in one piece with one another in this area. As a result, if necessary, a particularly strong support of the foot can be achieved in the region of the longitudinal arch spanning the coupling section of the foot standing on the shoe sole.

According to the invention, the cross-section of the front foot part of the supporting device is preferably smaller overall than the cross-section of the rear foot part (RFP) of the supporting device. According to a preferred development, the overall height of the front foot part decreases in the direction of the central axis of the shoe sole towards the shoe sole tip.

The rear foot part and the front foot part of the supporting device preferably comprise an elastomer or are formed from such an elastomer. As a result, a desired cushioning capacity of the shoe sole can be set in a simple and inexpensive manner.

The rear foot part and the front foot part can each consist of solid material or a foamed elastomer or comprise this. The rear foot part (RFT) and/or the front foot part (FFT) of the supporting device can for example be made of a (highly responsive) thermoplastic elastomer, such as thermoplastic polyurethane (TPU) having a low density (45-50 Asker ShoreC). Alternatively, the supporting device can also consist of an elastically deformable fiber composite material.

According to one particularly preferred development of the invention, the rear foot part and the front foot part of the support device are each designed in the form of a tube. A particularly high mechanical cushioning capacity of the supporting device can thereby be achieved.

The supporting device, i.e. the rear foot part and the front foot part, particularly preferably has a round, i.e. essentially circular or ellipsoidal, cross-sectional shape as a whole or over a large part of its (longitudinal) extent. The (functionally) quasi-punctual support under the strand-like or tube-shaped supporting device enables the ground reaction forces mentioned at the outset to be minimized as early as the first contact of the shoe sole (=impact) with the ground.

The supporting device is preferably glued to the supporting sole. As an alternative or in addition, the supporting device can also be welded to the supporting sole or be held in a press fit on the supporting sole.

The supporting device can have at least two portions which differ from one another in terms of their material properties. For example, the two medial limbs of the rear foot part and the front foot part can consist of a less elastic material than the other regions of the supporting device. As a result, a desired supporting capacity of the supporting device can be adapted to the (individual) needs in certain regions.

According to the invention, the outsole covering of the shoe sole can in particular be profiled and preferably consists of an advantageously abrasion-resistant rubber or some other suitable material. The outsole covering ensures the necessary friction between the shoe sole and the respective surface and counteracts undesirable slipping, especially when placing the foot and when pressing (pushing off).

The shoe according to the invention has a shoe sole and, in a manner known per se, an upper part fastened to the shoe sole. The shoe can in particular be designed as a running shoe. It goes without saying that the shoe can also be designed for sports other than running, in particular for tennis, squash, or as a so-called leisure shoe.

Further advantages of the invention can be found in the description and the drawings. Likewise, according to the invention, the aforementioned features and those which are to be explained below can each be used individually for themselves or for a plurality of combinations of any kind. The embodiments shown and described are not to be understood as an exhaustive enumeration but rather have exemplary character for the description of the invention.

DETAILED DESCRIPTION OF THE PREFERRED EMBODIMENTS

Figure 1:
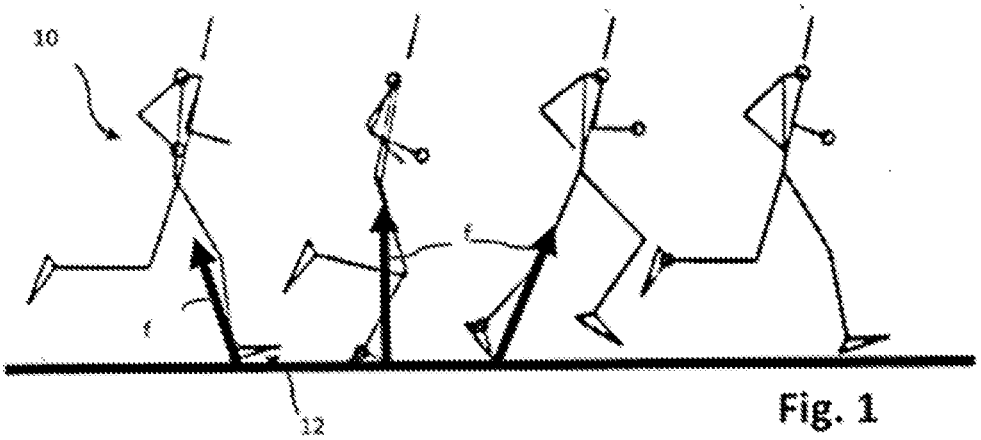
FIG. 1 is a schematic representation of a runner with a representation of the ground reaction forces for chronologically successive points in time of the movement sequence.

FIG. 1 shows a schematic serial image of a runner 10 during a natural running movement at different times from the beginning of the ground contact of a foot 12 to after the push-off phase of the foot 12 in question, with the ground reaction force f shown in each case in a side view.

Figure 2:
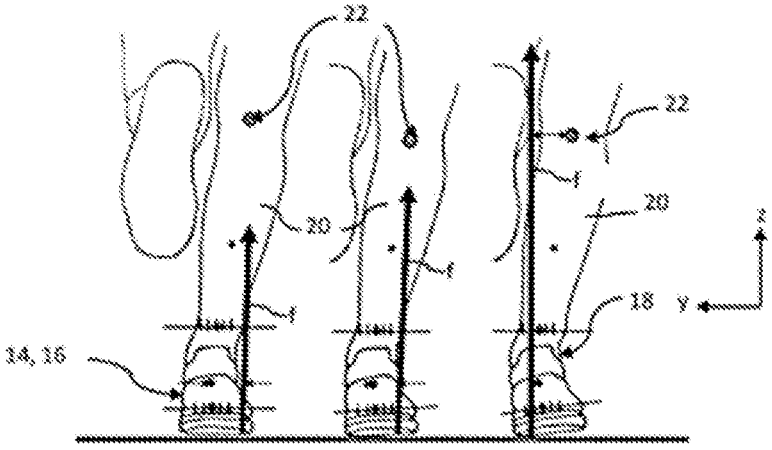
FIG. 2 shows a rear foot, lower leg, and knee in the early standing phase with ground reaction force as well as the resulting leverage of the ground reaction force to the ankle and knee when using a shoe with a conventional shoe sole concept, each shown in the frontal plane.

FIG. 2 shows the foot 16 provided with a shoe 14, the ankle 18, the lower leg 20, and the knee 22 of the runner 10 (FIG. 1) with ground contact in the early standing phase at successive times A, B, C with superimposed ground reaction force f in the frontal plane.

The ground reaction force f (more precisely its mediolateral (ml-/y-) component and z-component according to a right-handed three-dimensional coordinate system) causes an external eversion moment at the ankle joint 18 in the early support phase, which tilts the rear foot inward (B, C) and pushes the ankle 16 with the distal tibia of the lower leg 18 in a medial direction. The medialization of the distal tibia results in increased adduction of the knee 20 and an increase in the leverage of the ground reaction forces fin the frontal plane to the knee. This increases the external adduction moment at the knee joint 20 (C). Leverage forces f at the ankle and knee joints 18, 22 derived from the ground reaction forces f can lead to overloading and damage to the ankle 18 and the knee 20 and require unnecessary muscle work.

Figure 3:
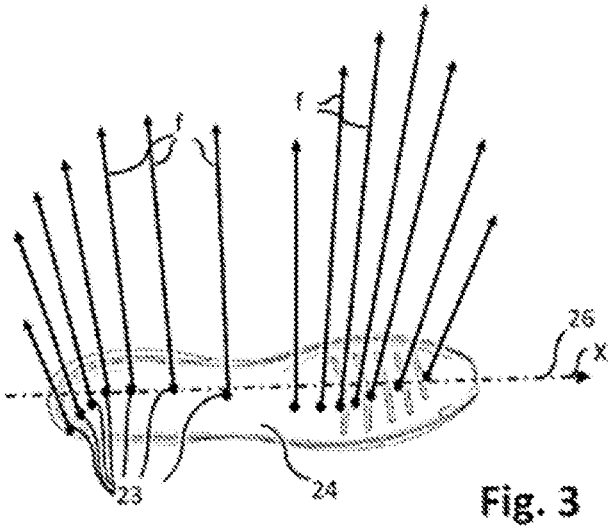
FIG. 3 shows a conventional shoe sole of a running shoe with a representation of the ground reaction forces, the spatial movement sequence of the force application point in the plane of the shoe sole, in a perspective view.

FIG. 3 shows force application points (FAP) 23 of the ground reaction forces f introduced into a conventional shoe sole 24 of a shoe, spatially resolved in two dimensions, in their respective position on the shoe sole 24 during a ground contact phase. The force application points 23 show clear medial/lateral deviations from posterior to anterior from the longitudinal center axis 26 of the shoe sole 24, which essentially coincides with the axial projection of the longitudinal axis of the foot.

Figure 4:
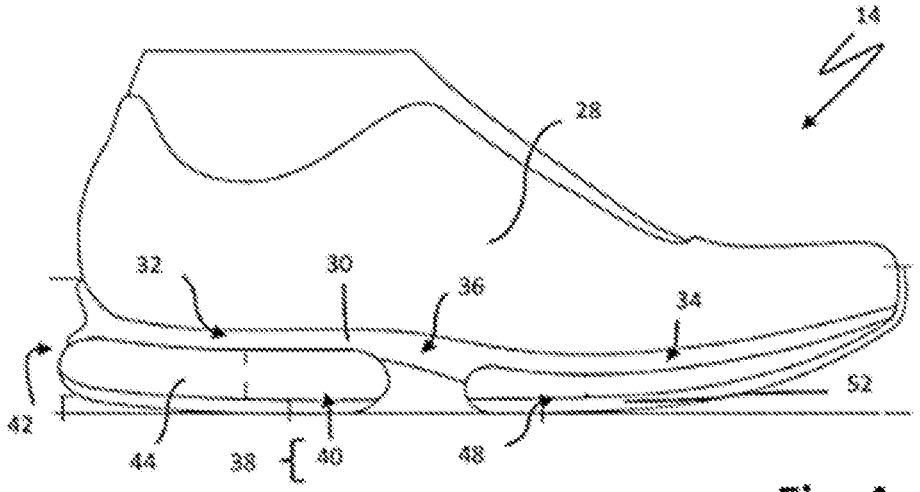
FIG. 4 shows a running shoe according to the invention with a shoe sole having a supporting sole and with an elastically deformable supporting device on which the supporting sole is supported with its edge section on the underside, the supporting device having a rear foot part which at least partially engages around the rear sole portion in a U shape and having a front foot part, which with both its limbs laterally frames the front foot portion of the supporting sole.

FIG. 4 shows a shoe 14 according to the invention, here by way of example in the form of a jogging or running shoe, which has a shoe sole 24 and an upper shoe part 28 that is suitably connected to the shoe sole 24, for example glued, welded and/or sewn. The representation of a lacing or any other type of closure system has been omitted here, especially since this is not essential for the representation of the invention.

Figure 5:
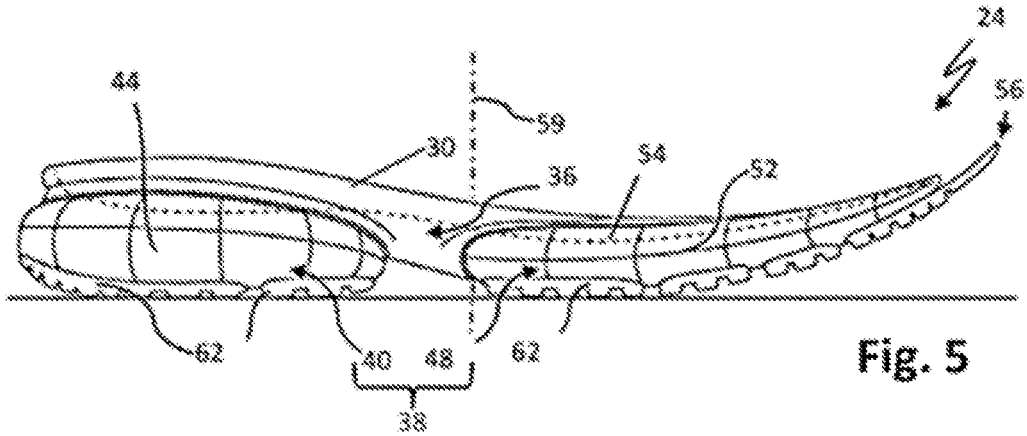
FIG. 5 shows the shoe sole in an exposed side view.
Figure 6:
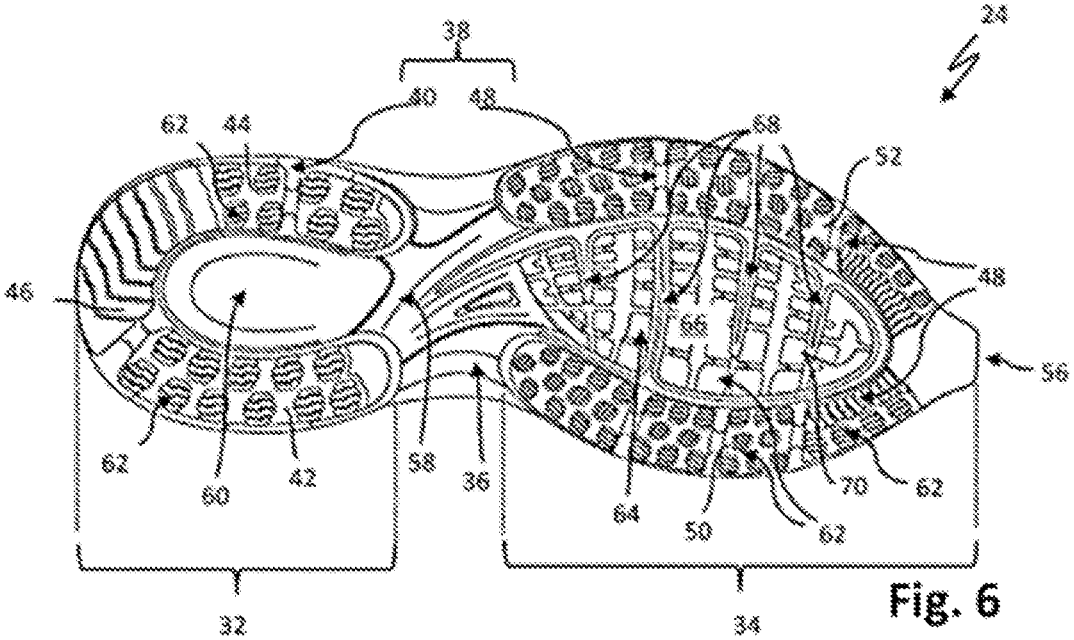
FIG. 6 shows the shoe sole according to FIG. 4 in a plan view of the lower tread.

The shoe sole 24 is shown in FIGS. 5 and 6, each shown in an exposed view. The shoe sole 24 has an elastically deformable supporting sole 30, which functionally essentially corresponds to an insole. The supporting sole 30 comprises a rear foot section 32 and a front foot section 34 (FIG. 6) which are mutually connected to one another via a metatarsal or coupling section 36. The supporting sole 30 is functionally essentially comparable to the classic insole of a shoe sole 24. The supporting sole 30 can, for example, be made of a viscoelastic foam, e.g. an ethylene-vinyl acetate or an ethylene-vinyl acetate copolymer (EVAC), for example having a density of about 55 Asker Shore C. It should be noted that other elastically deformable materials can also be used. For example, the supporting sole can comprise a flexibly deformable fiber composite material with natural fibers or synthetic fibers or consist of such a material.

An elastically deformable support device 38 is attached to the supporting sole 30. The supporting device 38 can in particular be glued to the supporting sole 30. Depending on the materials used for the supporting sole 30 and the supporting device 38, the supporting device 38 can also be welded to the supporting sole 30 or held in a press fit in/on the supporting sole 30. The material of the supporting sole 30 is preferably more rigid, i.e. less elastically deformable, than the material of the supporting device 38.

The supporting device 38 for its part comprises a U shaped rear foot part 40 which engages around the rear foot section 32 of the supporting sole 30. The rear foot part 40 has a first (lateral) and a second (medial) limb 42, 44, which are mutually connected to one another via a rear portion 46. The rear foot part 40 thus frames the rear foot portion 32 of the supporting sole.

The elastically deformable supporting device 38 further comprises a front foot part, designated as a whole by 48, having a first (lateral) and a second (medial) limb 50, 52, which are each arranged along opposite edge sections 54 of the front foot section 34 of the supporting sole 30. The front foot part 48 is preferably attached to the supporting sole in a manner corresponding to the rear foot part 40.

The rear foot part 40 can in particular be made in one piece. In the embodiment shown, the U shaped rear foot part 40 of the supporting device 38 forms an opening 58 pointing in the direction of the longitudinal center axis 26 (x-axis) of the shoe sole 24 towards the front end of the shoe sole, i.e. towards the shoe sole tip 56. A free space 60 is delimited by the rear foot part of the supporting device in a direction radial to the vertical axis 59 (z-axis) of the shoe sole 24 and is delimited on the upper side by the supporting sole 30 in the vertical direction.

An outsole covering 62 is fastened on the underside of the supporting device 38, that is to say on the rear foot part 40 and the front foot part 48. The outsole covering 62 consists of a material suitable for the respective area of application of the shoe 14 and can be provided with a profile 64 in a manner known per se. From a manufacturing point of view, the outsole covering 62 is preferably glued to the supporting device 38 or fastened to it in another suitable manner.

A push-off island 66 is arranged between the two limbs 50, 52 of the front foot part 48 of the supporting device 38. The push-off island 66 is elastically deformable and forms a pressing platform for pushing off when running. The push-off island 66 is advantageously segmented by flex zones 68 in order to ensure the necessary flexibility of the shoe sole 24 when running. The spatial course of the flex zones 68 relative to the supporting sole 30 can be adapted to an externally rotated foot placement that is often found in runners. It should be noted that the push-off island 66 is not arranged with the surface 70 of its outsole covering 62 flush with the surface 70 of the outsole covering 62 of the two limbs 50, 52 of the front foot part 48 of the supporting device 38 in the direction of the vertical axis 59 (z-direction). The push-off island 66 is rather arranged set back by a few millimeters, for example 2 to 4 millimeters, with respect to the surface 70 of the outsole covering 62 of the front foot part 48.

Figure 7:
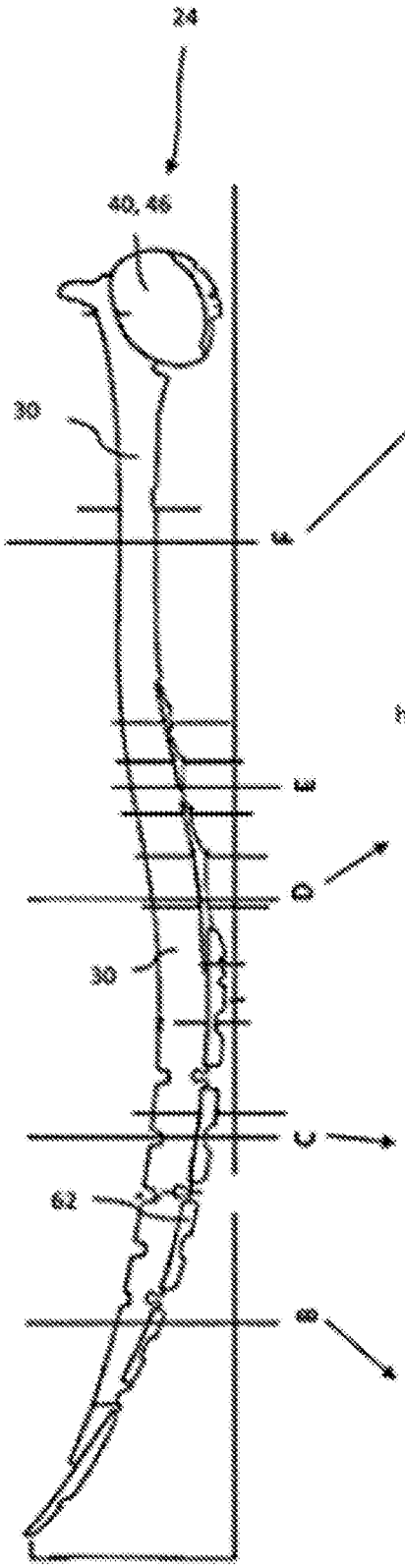
FIG. 7 shows the shoe sole according to FIG. 4 in a longitudinal section.

The mounting of the supporting sole 30 on the elastically deformable supporting device 38 is shown in more detail in FIGS. 7 to 11. FIG. 7 shows the shoe sole 24 in a longitudinal section along the longitudinal center plane L of the shoe sole 24, while in FIGS. 8 to 11, individual cross-sections of the shoe sole 24 are shown.

Figure 8:
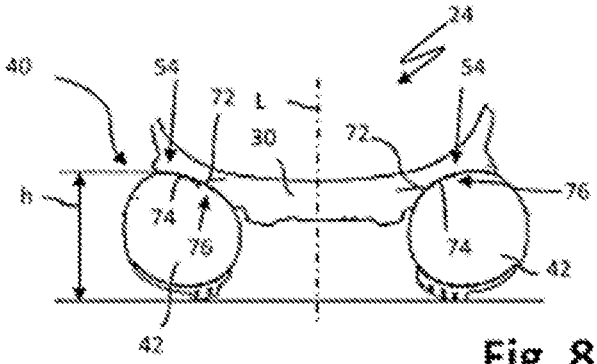
FIG. 8 shows the shoe sole according to FIG. 7 in a cross-section along the section line designated by F-F in FIG. 6.

According to FIGS. 7 and 8, the rear foot part 40 of the elastically deformable supporting device 38 has an almost round, here oval cross-sectional shape. The supporting device 38 can be made of a solid material, foamed if necessary, or alternatively also in the form of a tube. An elastically deformable fiber composite material is also conceivable.

The large outer radius of the rear foot part 40 (FIG. 7) counteracts undesirable leverage forces on the ankle and knee when it touches down. According to the cross-sectional representations of the shoe sole 24 in FIGS. 9 to 11 of the shoe sole 24, the supporting device 38 has an overall round or rounded cross-sectional shape.

The rear foot part 40 and the front foot part 48 each have a supporting surface 72 which is inclined toward the bottom of the shoe sole or is convexly curved and on which the supporting sole 30 rests and is supported in a lateral direction, i.e. outward in a direction radial to the vertical axis (z-direction).

In the area of the rear foot part, the supporting surface of the supporting device is convexly curved. In cross-section, the supporting sole has a concave contact or supporting surface 74 which is shaped to correspond or complement it. The rear foot part 40 of the supporting device 38 engages positively in the receptacle or pocket 76 of the supporting sole 30 formed thereby.

The front foot part 48 of the supporting device has a smaller overall height h than the rear foot part 40. The cross-sectional area of the front foot part 48 of the supporting device 38 decreases towards the tip of the shoe sole 56 (FIG. 7). The lateral extension of the supporting surfaces 72 of the front foot part 48 of the supporting device 38 becomes increasingly smaller along the longitudinal center axis 26 of the shoe sole in the direction of the shoe sole tip 56.

Figure 9:
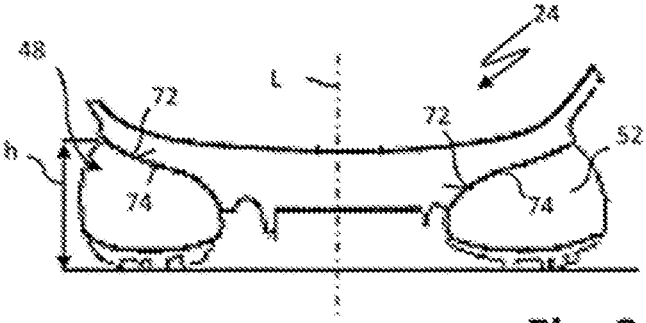
FIG. 9 shows the shoe sole according to FIG. 7 in a cross section along the section line designated by D-D in FIG. 6.
Figure 10:
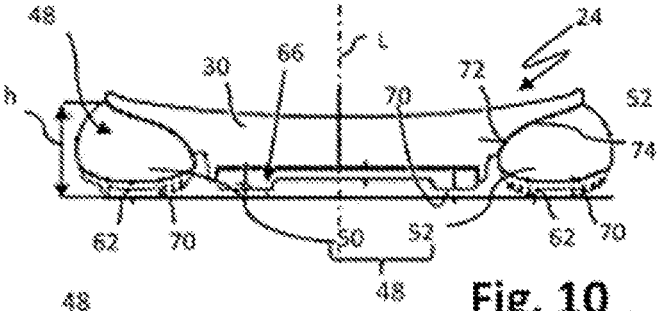
FIG. 10 shows the shoe sole according to FIG. 7 in a cross section along the section line designated by C-C in FIG. 6.
Figure 11:
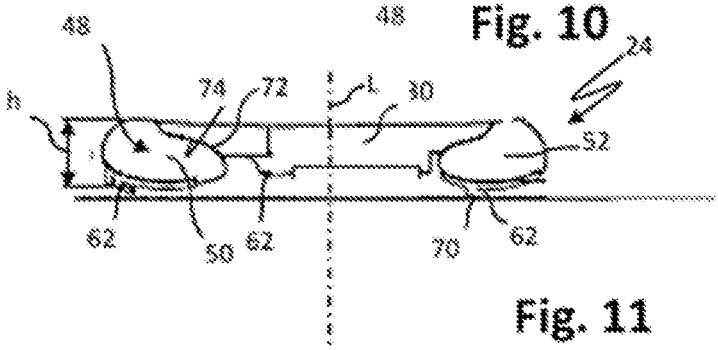
FIG. 11 shows the shoe sole according to FIG. 7 in a cross section along the section line designated B-B in FIG. 6.

In FIGS. 9 to 11, the surface 70 of the push-off island 66, which is set back (recessed) with respect to the surface 70 of the outsole covering 62, can be clearly seen.

Figure 12:
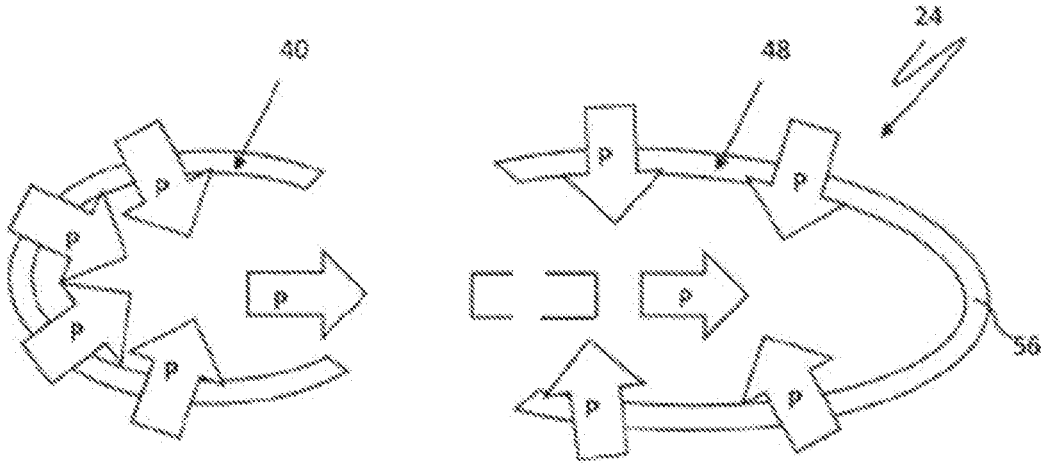
FIG. 12 shows a schematic representation of the operating principle of the shoe sole according to the invention according to FIGS. 4 to 11.
Figure 13:
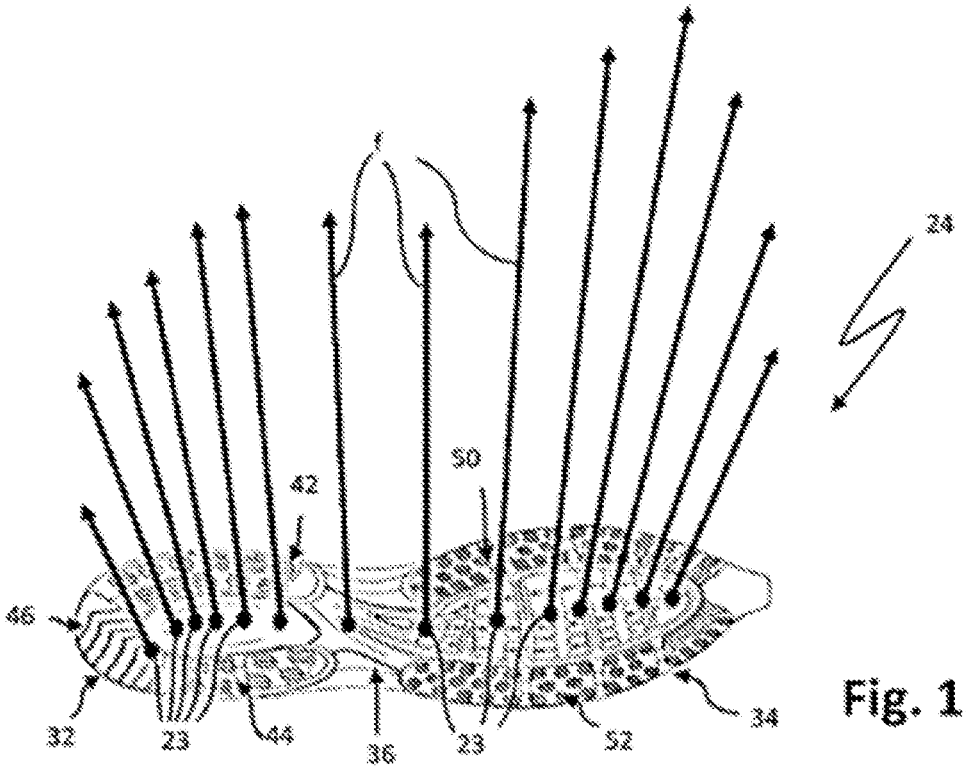
FIG. 13 shows the shoe sole according to the invention according to FIG. 4 with a representation of the ground reaction forces and the localization of the force application point on the shoe sole during a ground contact phase, in a perspective view.
Figure 14:
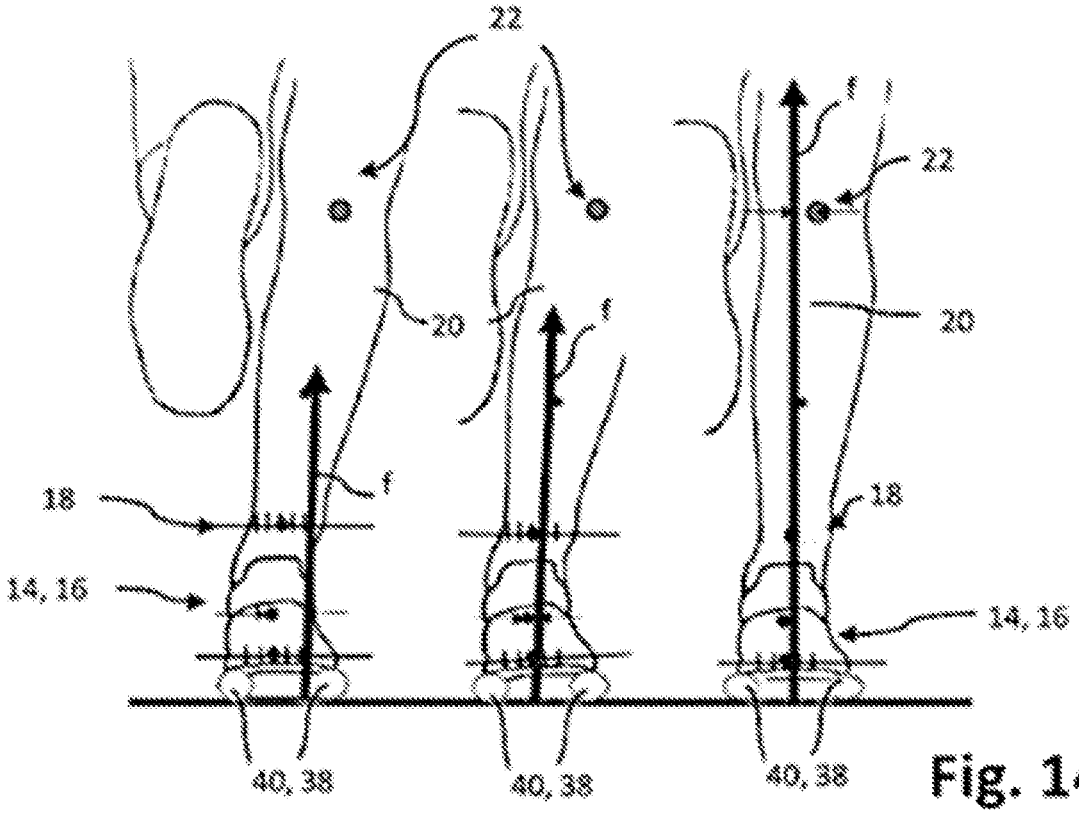
FIG. 14 shows a rear foot, lower leg, and knee in the early standing phase with ground reaction force and the resulting leverage of ground reaction force to the ankle and knee when using a shoe according to FIG. 4 having a shoe sole concept according to the invention, each represented in the frontal plane.

The coordinated elastic deformability of the supporting sole 30 and the supporting device 38 with outsole covering 62, which provides ground contact, as well as the laterally supported mounting of the supporting sole 30 on the supporting device 38 enables the centering of the force application point 23 in the ml direction when the shoe sole 24 is placed with respect to the longitudinal center axis 26 or longitudinal center plane L, and to guide it centered in the ap (anterior-posterior) direction anteriorly in the direction of the front foot area, as is shown in a highly schematized manner with the arrows P in FIG. 12 and in FIG. 13 in a manner corresponding to FIG. 3. As a result, external torques in the frontal and transverse planes at the ankle 18 and knee 22 according to FIG. 14 can be minimized. In addition, the force application point 23 can be guided from the rear foot contact to the front foot contact with improved use of the biomechanical potential of the biological coupling elements of the metatarsus (ligaments, tendons, intrinsic foot muscles) in the ap direction forward to the front foot area. Through the ml-centering and ap-orientation of the force application point in the front foot support and push-off, the propulsion efficiency can also be improved. The advantages of the shoe sole 24 according to the invention are given in all forms of foot placement.

What is claimed is:

1. A shoe sole for a shoe, for the sport of running, comprising:

an elastically deformable supporting sole, which has a rear foot section and a front foot section, which are mutually connected to one another via a coupling section, the supporting sole defining a longitudinal center axis extending from the rear foot section through the coupling section and to the front foot section, the supporting sole defining a longitudinal center plane through the longitudinal center axis separating a medial side from a lateral side, and the supporting sole connected to an upper shoe part; and an elastically deformable supporting device which is arranged on the supporting sole and which carries an outsole covering, wherein the supporting device comprises:

a rear foot part which engages around the rear foot section of the supporting sole in a U shape; and a front foot part having two limbs which are arranged on opposite lateral edge sections of the front foot section;

wherein the rear foot part and the front foot part each have a supporting surface, which is arranged to run obliquely inward toward the underside of the shoe sole and is at least partially curved convexly in at least one cross-section, the at least one cross-section being perpendicular to the longitudinal center axis;

wherein the supporting sole has a receptacle matching the shape of the supporting device where it makes contact with the supporting surface, and wherein the receptacle making contact with the supporting surface through the at least one cross-section defines a plurality of contact points along the receptacle when traced in a direction perpendicular to the longitudinal center plane along the receptacle, and wherein each of the plurality of contact points respectively defines a plurality of tangent planes between the receptacle and the supporting surface, wherein each of the plurality of tangent planes is at an acute angle that is less than perpendicular in relation to the longitudinal center plane and wherein the acute angle is open-facing in relation to the upper shoe part;

wherein the rear foot part consists of solid material or a foamed elastomer;

wherein the front foot part consists of solid material or a foamed elastomer; and wherein the receptacle of the supporting sole rests on the supporting surface of the supporting device and is supported in the lateral direction.

2. The shoe sole according to claim 1, wherein the front foot section has a push-off island with an outsole covering, the surface of which is arranged set back in the direction of a vertical axis of the shoe sole relative to the surface of the outsole covering of the front foot part.

3. The shoe sole according to claim 2, wherein the push-off island together with its outsole covering is segmented by flex zones.

4. The shoe sole according to claim 1, wherein the two limbs of the front foot part of the supporting device are made in one piece with one another, wherein the front foot part engages around the supporting sole in an area around a shoe sole tip.

5. The shoe sole according to claim 4, wherein the front foot part of the supporting device is materially weakened in the region of the shoe sole tip.

6. The shoe sole according to claim 1, wherein the supporting device, over a large part of its extent or over its entire extent, has an overall round or rounded cross-sectional shape.

7. The shoe sole according to claim 1, wherein the supporting device has different material properties of elasticity, at least in sections.

8. The shoe sole according to claim 7, wherein at least two portions of the supporting device differ from one another in terms of their elasticity, wherein a first portion is of a less elastic material than a second portion of the supporting device.

9. The shoe sole according to claim 1, wherein the supporting device is welded to the supporting sole and/or is glued to the supporting sole.

10. The shoe sole according to claim 1, wherein the rear foot part and the front foot part can consist of different materials.

11. The shoe sole according to claim 1, wherein the supporting sole is arranged in portions between the supporting device in the loaded and also in the unloaded operating state.

12. The shoe, for the sport of running, having the shoe sole according to claim 1.

* * * * *